United States Patent [19]

Frey et al.

[11] 4,442,379

[45] Apr. 10, 1984

[54] HIGH PRESSURE SODIUM VAPOR LAMP HAVING RESISTANCE HEATER MEANS

[75] Inventors: Robert G. Frey, Strongsville; Charles I. McVey, Shaker Heights, both of Ohio

[73] Assignee: General Electric Company, Schenectady, N.Y.

[21] Appl. No.: 403,900

[22] Filed: Jul. 30, 1982

[51] Int. Cl.[3] ..... H05B 41/16; H01J 61/56

[52] U.S. Cl. ..... 315/47; 315/73; 315/108; 315/116

[58] Field of Search ..... 315/46, 48–50, 315/56, 73, 108, 115–117, 47

[56] References Cited

U.S. PATENT DOCUMENTS 3,851,207 11/1974 McVey ..... 315/49

4,182,976 1/1980 Larson ..... 315/49

*Primary Examiner*—Eugene R. Laroche

*Attorney, Agent, or Firm*—John F. McDevitt; Philip L. Schlamp; Fred Jacob

[57] ABSTRACT

An improved high pressure sodium vapor lamp is described having resistance heater means contained within a tubular light-transmitting ceramic envelope that further contains a reservoir of sodium-mercury amalgam in excess of the quantity vaporized during lamp operation in order to increase the quantity of amalgam being vaporized during lamp operation and thereby help maintain the desired lamp color temperature. In a preferred embodiment, said resistance heater means comprises a refractory metal coil wound around the tungsten shank of one thermionic electrode and electrically insulated therefrom with said thermionic electrode including a tubular metal inlead serving as the amalgam reservoir.

14 Claims, 3 Drawing Figures

Fig. 1
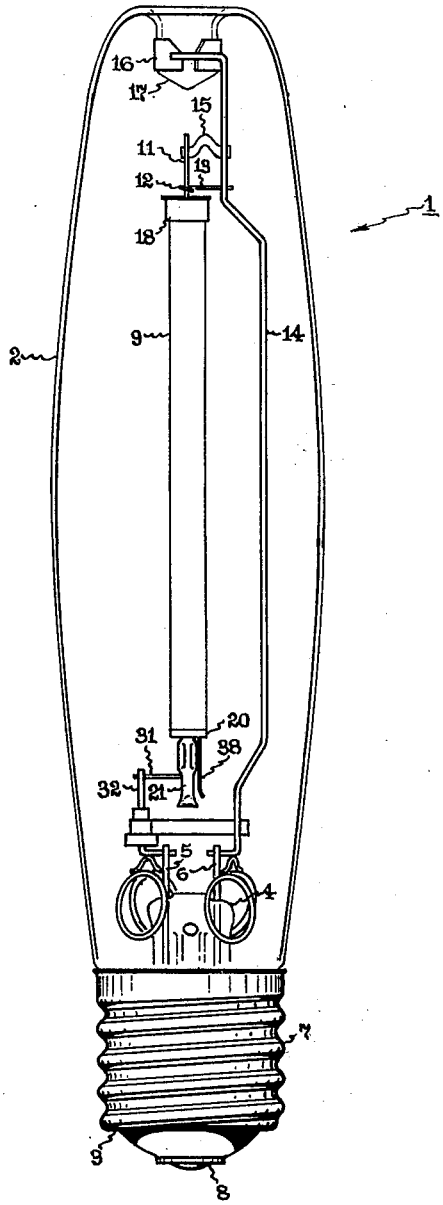
Fig. 2
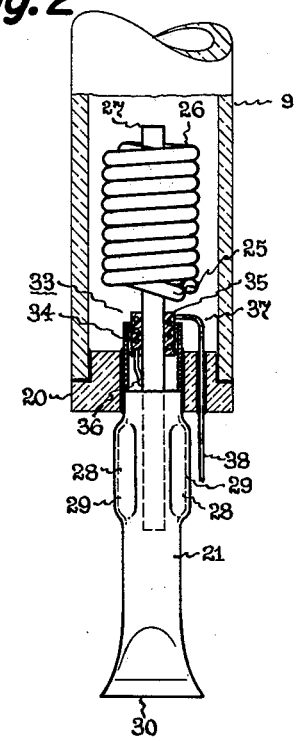
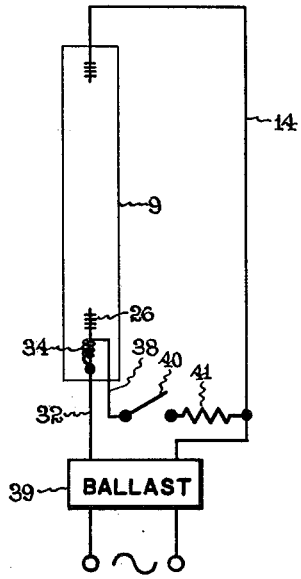
Fig. 3

HIGH PRESSURE SODIUM VAPOR LAMP HAVING RESISTANCE HEATER MEANS

BACKGROUND OF THE INVENTION

Resistance heater means are already known as a starting aid in high pressure sodium vapor lamps. For example, in U.S. Pat. No. 4,001,634, there is described thermal starter means for this type lamp in the form of a bimetal switch which is located outside the conventional ceramic arc tube and which upon opening responsive to the applied electrical current generates an inductive voltage pulse said to be sufficient to ionize the starting gas in the arc tube and start lamp operation. It is also known that the color temperature of high pressure sodium vapor lamp operation varies undesirably with the overall lamp color point depending to a significant degree on the temperature of the cold spot in the arc tube where amalgam condensation takes place. The "cold spot" temperature controls amalgam vapor pressure inside the arc tube thereby increasing or decreasing the amount of vaporized amalgam which produces the visible lamp emission as well as the color of said lamp emission.

Resistance heater means have also been located inside the arc tube of a sodium vapor lamp to stabilize the cold spot temperature and amalgam vapor pressure which tend to rise during lamp operating life. The undesired variation is attributable to operating voltage rise that eventually reaches the ballast sustaining voltage and determines the end of lamp life in this type lamp. Said resistance heater means is supplied with the lamp current which inherently decreases with an increase in the lamp operating voltage and reduces supplemental heating of the amalgam reservoir as the stabilizing mechanism for improved lamp operation. A representative sodium vapor lamp incorporating this type resistance heater means is described in U.S. Pat. No. 3,851,207 wherein the heater element simply comprises an integral part of the thermionic electrode coil. Understandably, the power consumed by such heater means reduces the lamp operating efficiency and this power loss will be greatest at the initial lamp operation. Since the present lamp designs exhibit only a 20 volt rise after 15,000 hours of lamp operation, such loss in lamp operating efficiency seems excessive expecially when encountered before any voltage rise takes place.

Accordingly, it would be desirable to provide improved means whereby the vaporized amalgam in this type lamp can be adjusted to compensate for varation in the lamp cold spot temperature. It would also be desirable to do so in a manner which does not add significant cost to the lamp design or its cost or manufacture.

SUMMARY OF THE INVENTION

It has now been discovered that resistance heater means located within the ceramic arc tube adjacent the amalgam reservoir in said electrode structure and supplied with electric current independent of the lamp current can serve to increase the quantity of amalgam being vaporized during lamp operation and thereby help maintain the desired lamp color temperature. By independently heating the arc tube in this manner during lamp operation, no loss in lamp operating efficiency should result due to some power being consumed for supplemental heating at the expense of the lamp operating discharge. The present improvement should also enable lower wattage lamps of this type to be constructed since conventional lamps without supplemental electrode heating have a minimum wattage requirement needed to sustain the lamp operating discharge.

Basically, the presently improved high pressure sodium vapor lamp construction includes a tubular light-transmitting ceramic envelope containing a reservoir of sodium-mercury amalgam in excess of the quantity vaporized during lamp operation and thermionic electrodes being sealed into its ends, wherein the improvement comprises further including within said ceramic envelope resistance heater means disposed adjacent the amalgam reservoir which are supplied with electric current other than the lamp current to increase the quantity of amalgam being vaporized during said lamp operation and thereby help maintain the desired lamp color temperature. While the proposed resistance heater means can operate continuously during normal lamp operation to compensate for any decrease in the lamp operating voltage, it is also contemplated that said resistance heater means can be actuated with conventional circuitry for intermittent operation responsive to either increase or decrease of the cold spot temperature in the arc tube. A thermally responsive switch located within the outer vitreous envelope of the lamp but adjacent to the cold spot location in the arc tube can provide a convenient means to achieve such intermittent operation without having to alter the lamp ballast circuitry.

In a preferred embodiment, the presently improved high pressure sodium vapor lamp comprises a tubular light-transmitting ceramic tube having closures and thermionic electrodes in its ends, and containing a reservoir of sodium-mercury amalgam in excess of the quantity vaporized during lamp operation along with inert gas, such as xenon, to facilitate starting, one of said closures and thermionic electrodes comprising a tubular metal inlead conductor hermetically sealed to said ceramic tube and externally extending therefrom to provide said amalgam reservoir at its external end and said tubular metal inlead being joined at its opposite end to an electrode located within said ceramic tube mounted on a metal shank, wherein the improvement comprises resistance heater means being disposed adjacent said metal shank and supplied with lower electric current than the lamp current to increase the quantity of amalgam being vaporized during said lamp operation and thereby help maintain a desired lamp color temperature. The thermionic electrode structures employed in said preferred lamp embodiment comprise refractory metal coils wound around a tungsten shank. The resistance heater means includes a refractory metal coil wound around the tungsten shank of one thermionic electrode but electrically insulated therefrom and which is supplied with less current than the current supplied to said electrode. One end of said refractory metal coil is electrically connected by direct joinder to said tungsten shank with the other end of said coil being electrically connected to an inlead emerging from the ceramic arc tube. The preferred lamp embodiment further includes an outer evacuated light-transmitting vitreous envelope surrounding said ceramic tube having a stem press seal at one end through which extend a pair of inleads electrically connected to said thermionic electrodes along with inlead means for the resistance heater means. The inlead electrically connected to one end of the refractory metal coil providing the resistance heating further extends to circuit means in the outer vitreous envelope for an independent supply of electric current thereto.

BRIEF DESCRIPTION OF THE DRAWINGS

FIG. 1 shows a high pressure sodium vapor lamp embodying the presently improved resistance heating means;

FIG. 2 is an enlarged detailed view of the exhaust tube electrode member incorporating said resistance heater means; and FIG. 3 is a schematic electrical circuit to operate said resistance heating means during lamp operation.

DETAILED DESCRIPTION OF THE PREFERRED EMBODIMENTS

Referring to FIG. 1, a high pressure sodium vapor lamp 1 corresponding to a 400-watt size is illustrated which comprises vitreous outer envelope 2 having a standard mogul screw base 3 attached to one end and comprising a reentrant stem press seal 4 through which extend, in conventional fashion, a pair of relatively heavy lead-in conductors 5 and 6 whose outer ends are connected to the screw shell 7 and eyelet 8 of the base. The inner envelope or arc tube 9 centrally located within said outer envelope comprises a length of light-transmitting ceramic tubing, preferably polycrystalline alumina ceramic, or which can be single crystal alumina which is clear and transparent. The upper end of the arc tube is closed by a conventional ceramic end closure through which extends a niobium inlead wire 11 hermetically sealed. Said inlead supports the upper electrode which may be generally similar to the lower electrode illustrated in FIG. 2. A preferred upper end closure and electrode support structure is described in U.S. Pat. No. 4,034,252, also assigned to the assignee of the present invention. The external portion of inlead 11 passes through a loop 12 in transverse support wire 13 attached to a side rod 14. This arrangement allows for thermal expansion of the arc tube during lamp operation when the lower end seal is rigidly fixed in place, and a resilient metal ribbon 15 assures continued good electrical connection. A metal reflector band 18 may be desirable around the upper end of the arc tube to help in maintaining a higher electrode operating temperature, particularly in smaller sizes of lamps such as 250 watts or less. The lower end closure and electrode support assembly 20 for said lamp has a central aperture through which extends a thin-walled niobium tube 21 serving as an exhaust tube and as an inlead. Said tube extends but a short distance through the ceramic end closure and is hermetically sealed therethrough by sealing frit in the conventional manner. The closed arc tube is supported in the outer envelope by a connector 31 which is welded across from tubular inlet 21 to a support rod 32 joined to lead-in conductor 5. A second lead-in conductor 38 shown emerging from said lower end closure and connected to the resistance heater means contained within the arc tube further extends to the circuitry later described in FIG. 3 to provide electric current independent from the lamp current. Also not shown in the present drawing is a filling of xenon gas within the arc tube to help establish the lamp operating discharge.

The present invention resides in the resistance heater means itself which is depicted in greater detail for the lower electrode structure and the electrode support assembly therefor as shown in FIG. 2. Specifically, said electrode proper comprises two layers of tungsten wire 25 and 26 wound around the distal end of a tungsten shank 27 and located within the ceramic envelope. The shank extends far enough down into tube or inlead 21 so that it can be securely locked in place by deforming the tube in a place outside the ceramic envelope by pinching the shank over an appreciable length. Preferably the deformation is at an intermediate point in the tube which leaves a portion beyond it adequate to serve as a reservoir for excess amalgam. The illustrated crimp, sometimes known as a butterfly crimp, is of such a character, that it pinches the shank along the entire length of the flattened portions or wings 28. At the same time, restrictive channels 29 are left on both sides of the shank which communicate with the outer portion of the exhaust tube up to the tip 30. They allow passage of the sodium mercury amalgam in vapor form but prevent its movement as a liquid under ordinary operating conditions, even when the lamp is upended. The depicted resistance heater means 33 comprises a refractory metal coil 34 wound around the tungsten shank 27 and electrically insulated therefrom with ceramic sealing frit 35. One end 36 of said refractory metal coil 34 is directly secured to the tungsten shank 27, such as by welding and the like, with the remaining end 37 of said refractory metal coil being electrically connected to an inlead 38 emerging from said arc tube.

A schematic electrical circuit having representative components to automatically operate the present resistance heater means during lamp operation is shown in FIG. 3. As depicted, the circuit connections to the upper and lower thermionic electrodes from conventional ballast member 39 are made by conductors 14 and 32, respectively, in a manner permitting electrical current to be supplied to the refractory metal coil 34 of the present resistance heater means at the same time. This occurs, as previously explained, by having one end of the refractory metal coil directly connected to the tungsten shank of lower thermionic electrode 26 with the remaining end of said refractory metal coil being electrically connected to inlead 38. By further terminating said inlead 38 as shown to the electrical conductor 14, there is provided the circuit means to actuate said refractory metal coil 34 after the lamp operating discharge has been established in the customary manner. More particularly, there is positioned in the outer vitreous envelope of said lamp a conventional normally open thermally responsive switch 40 sufficiently proximate to the arc tube 9 to close after said arc tube has been heated by the lamp operating discharge. A series electrical connection of this switch and resistor 41 in the branch circuit formed with inlead 38 provides the means to supply electric current at a low level to heat said refractory metal coil while the switch remains closed.

It will be apparent from the foregoing description that resistance heater means have been provided for high pressure sodium vapor type lamps which is generally useful. It will be further apparent to those skilled in the lamp art, however, that said improvement can be incorporated in other type sodium vapor lamps than above specifically disclosed. For example, both designs utilizing additional gettering and starting aids can use the present resistance heater means to the same advantage. Accordingly, it is intended to limit the present invention only by the scope of the following claims.

What we claim as new and desire to secure by United States Letters Patent is:

1. An improved high pressure sodium vapor lamp having a tubular light-transmitting ceramic envelope containing a reservoir of sodium-mercury amalgam in excess of the quantity vaporized during lamp operation and thermionic electrodes being sealed into its ends, wherein the improvement comprises further including within said ceramic envelope resistance heater means including a resistive heating element disposed adjacent the amalgam reservoir and electrically connected with respect to said electrodes to be supplied with electric current other than the lamp current responsive to thermal switch means to increase the quantity of amalgam being vaporized during said lamp operation and thereby help maintain the desired lamp color temperature.

2. An improved lamp as in claim 1 wherein the thermionic electrodes comprise refractory metal coils wound around a tungsten shank.

3. An improved lamp as in claim 2 wherein said resistance heater means comprises a refractory metal coil wound around the tungsten shank of one thermionic electrode and electrically insulated therefrom.

4. An improved lamp as in claim 3 wherein said refractory metal coil is electrically connected at one end to said tungsten shank and electrically connected at the other end to an inlead emerging from the ceramic envelope.

5. An improved high pressure sodium vapor lamp which comprises a light-transmitting ceramic tube having closures and thermionic electrodes at each end and containing a reservoir of sodium-mercury amalgam in excess of the quantity vaporized during lamp operation along with inert gas to facilitate starting, one of said closures and thermionic electrodes comprising a tubular metal inlead conductor hermetically sealed to said ceramic tube and externally extending therefrom to provide said amalgam reservoir at its external end and said tubular metal inlead being joined at its opposite end to an electrode located within said ceramic tube mounted on a refractory metal shank, wherein the improvement comprises resistance heater means including a resistive heating element being disposed adjacent said refractory metal shank and supplied by electric current other than the lamp current responsive to thermal switch means to increase the quantity of amalgam being vaporized during said lamp operation and thereby help maintain the desired lamp color temperature.

6. An improved lamp as in claim 5 wherein both thermionic electrodes comprise refractory metal coils wound around a tungsten shank.

7. An improved lamp as in claim 6 wherein said resistance heater means comprises a refractory metal coil wound around the tungsten shank of one thermionic electrode and electrically insulated therefrom.

8. An improved lamp as in claim 7 wherein said refractory metal coil is electrically connected at one end to said tungsten shank and electrically connected at the other end to an inlead emerging from the ceramic arc tube.

9. An improved lamp as in claim 5 wherein said ceramic tube is disposed within an outer evacuated light-transmitting envelope having a stem press seal at one end through which extends a pair of inleads electrically connected to said thermionic electrodes along with inlead means for the resistance heater means.

10. An improved lamp as in claim 9 wherein said resistance heater means comprises a refractory metal coil wound around a tungsten shank and electrically insulated therefrom which is electrically connected at one end to said tungsten shank and electrically connected at the other end to an inlead emerging from the ceramic tube and extending through the stem press seal of the outer vitreous envelope.

11. An improved method of operating a high pressure sodium vapor lamp having a tubular light-transmitting ceramic enclosure containing a reservoir of sodium-mercury amalgam in excess of the quantity vaporized during lamp operation and thermionic electrodes being sealed into its ends which comprises:

(a) applying a first electric current to the thermionic electrodes sufficient to produce the lamp operating discharge; and (b) applying a second electric current independent from said first electric current to resistance heating means disposed in said ceramic envelope so as to increase the quantity of amalgam being vaporized during said lamp operation and thereby help maintain the desired lamp color temperature.

12. An improved method as in claim 11 wherein the electric current applied to the resistance heating means is varied with variation of the cold spot temperature in the ceramic envelope.

13. An improved method as in claim 11 wherein the electric current is applied to the resistance heating means before the lamp operating discharge is established.

14. An improved method of operating a high pressure sodium vapor lamp having a light-transmitting ceramic tube with closures and thermionic electrodes at each end and containing a reservoir of sodium-mercury amalgam in excess of the quantity vaporized during lamp operation along with xenon gas to facilitate starting, one of said closures and thermionic electrodes comprising a tubular metal inlead conductor hermetically sealed to said ceramic tube and externally extending therefrom to provide said amalgam reservoir at its external end and said tubular metal inlead being joined at its opposite end to an electrode located within said ceramic tube on a refractory metal shank which comprises:

(a) applying a first electric current to the thermionic electrode sufficient to produce the lamp operating discharge;

(b) actuating thermally responsive circuit means to continuously apply a second electric current independent from said first electric current to resistance heating means disposed in said arc tube adjacent said refractory metal shank; and (c) varying the amount of second electric current such that more current is applied when the cold spot temperature in said arc tube becomes lower.

* * * * *